US006269913B1

(12) United States Patent
Kollmannsberger et al.

(10) Patent No.: US 6,269,913 B1
(45) Date of Patent: Aug. 7, 2001

(54) ROLLER POSITION MONITORING DEVICE FOR AN INDUSTRIAL LIFT TRUCK

(75) Inventors: Otto Kollmannsberger, Moosburg; Johann Vockinger, Bruckberg; Martin Wichmann, Moosburg, all of (DE)

(73) Assignee: Steinbock Boss GmbH Fördertechnik, Moosburg (DE)

( * ) Notice: Subject to any disclaimer, the term of this patent is extended or adjusted under 35 U.S.C. 154(b) by 0 days.

(21) Appl. No.: 09/488,963

(22) Filed: Jan. 21, 2000

Related U.S. Application Data

(63) Continuation-in-part of application No. PCT/EP98/02160, filed on Apr. 14, 1998.

(30) Foreign Application Priority Data

Jul. 23, 1997 (DE) ..... 197 31 687

(51) Int. Cl.[7] ..... B66B 3/00

(52) U.S. Cl. ..... 187/394; 187/222; 414/273; 414/635

(58) Field of Search ..... 187/391–394, 187/222, 224; 414/266, 270, 273, 281–285, 635, 636, 630, 631; 364/478.1, 479.14

(56) References Cited

U.S. PATENT DOCUMENTS

| | | | | |
|---|---|---|---|---|
| 3,727,781 | * | 4/1973 | Ramsey | 187/9 |
| 4,206,829 | * | 6/1980 | Melocik | 414/631 |
| 4,411,582 | * | 10/1983 | Nakada | 414/636 |
| 4,499,541 | | 2/1985 | Yuki et al. | 364/424 |
| 4,598,797 | * | 7/1986 | Schultz | 187/9 E |
| 4,782,920 | * | 11/1988 | Gaibler et al. | 187/9 E |
| 5,011,358 | * | 4/1991 | Andersen et al. | 414/273 |
| 5,022,496 | * | 6/1991 | Klopfleisch et al. | 187/9 E |
| 5,056,437 | | 10/1991 | Maddock | 104/88 |
| 5,149,241 | * | 9/1992 | Haymore et al. | 414/279 |
| 5,220,731 | | 6/1993 | Waclawik et al. | 33/773 |
| 5,749,696 | * | 5/1998 | Johnson | 414/635 |
| 5,791,440 | * | 8/1998 | Lonzinski et al. | 187/223 |

FOREIGN PATENT DOCUMENTS

| | | |
|---|---|---|
| 3211486 | 10/1983 | (DE) . |
| 4234173 | 3/1994 | (DE) . |
| 19508346 | 6/1996 | (DE) . |
| 0335196 | 10/1989 | (EP) . |
| 2097553 | 11/1982 | (GB) . |

* cited by examiner

*Primary Examiner*—Jonathan Salata
(74) *Attorney, Agent, or Firm*—Baker Botts L.L.P.

(57) ABSTRACT

An industrial lift truck with a load lifting device (15), a device (3, 9, 11) for moving the load lifting device (15) on the lift truck (1) having at least one element (7) that can move, together with the load lifting device (15), along an essentially straight guide (5), and with a position measuring device for monitoring the relative position to the guide (5) of the element (7) movable with the load lifting device (15). The position measuring device has at least one roller body (19) that is arranged on the element (7) that is movable with the load lifting device (15) such that it is capable of rotation and rolls along a path (21) running along the guide (5) when the element (7) moves, whereupon the roller body acts in combination with a sensor which transmits an electric signal as a function of the rotational movement of the roller body to an analysis circuit which evaluates the signal to determine the position of the element (7) that is movable with the load lifting device (15), or the position of the load carrier (15), relative to the guide (5).

11 Claims, 2 Drawing Sheets

ROLLER POSITION MONITORING DEVICE FOR AN INDUSTRIAL LIFT TRUCK

CROSS REFERENCE TO RELATED APPLICATION

This is a continuation-in-part of PCT International Application PCT/EP98/02160 filed Apr. 14, 1998.

FIELD OF THE INVENTION

The invention relates to an industrial lift truck with a load lifting device and a device for moving the load lifting device on the lift truck having at least one element that can move, together with the load lifting device, along an essentially straight guide, and with a position measuring device for monitoring the position relative to the guide of the load lifting device or of the element movable with the load lifting device.

BACKGROUND

Industrial lift trucks with a position measuring device for determining the position of the load lifting device relative to a reference point on the lift truck in question are known.

For instance, DE 195 08 346 C1 discloses an industrial lift truck with a position measuring device for determining the lift height of an adjustable-height load lifting device. The load lifting device is driven by a hydraulic cylinder supplied by a hydraulic pump, which is driven by an electric motor. Starting from an initial position of the load lifting device, the rotations of the hydraulic pump are counted up in one direction of rotation and down in the opposite direction of rotation, and are evaluated in light of the overall efficiency of the lift system to determine the current lift height.

Moreover, with regard to industrial lift trucks, there has already been proposed the concept of providing the lifting frame for a load lifting device with proximity switches at predetermined intervals, which switches respond to a marking that is movable with the load lifting device in order to determine the current lift height of the load lifting device.

Known from DE 32 11 486 A1 is a forklift vehicle with the features mentioned at the outset, wherein the position measuring device includes a rotating disk with radial slits on its edge that is arranged on the shaft of a pinion provided in the upper region of the moving part of the lift mast to deflect a lift chain for the load carrying fork. An optical sensor arrangement with a light-emitting diode and a phototransistor is provided in the vicinity of the edge of the disk to measure the rotational motion of the disk. As the disk rotates, the light path formed by the light-emitting diode and the phototransistor is alternately unblocked by the edge slits and blocked by the teeth between the edge slits, so that the phototransistor delivers a pulsed electrical signal whose pulse count at any point corresponds to the angle of rotation of the disk and that of the chain sprocket that is rotationally fixed to the disk. The current change in lift height of the load carrying fork is determined from the angle of rotation of the chain sprocket that is engaged with the lift chain. Since the rotation of the chain sprocket when the load carrying fork is raised or lowered is determined by the length of the section of chain that passes over the chain sprocket, changes in the chain length such as those which frequently occur during operation under load will lead to errors in determining lift height. A further disadvantage of this known solution is that the sensor components (light-emitting diode, phototransistor, rotating disk) must be arranged on the moving part of the lift mast, since the chain sprocket attached to the rotating disk must be arranged on the moving lift mast section for functional reasons. This not only produces a design constraint, but is also invariably subject to the problems that arise when electrical signals are transmitted by moving sensors.

SUMMARY

It is an object of the invention to provide an industrial lift truck of the type described at the outset wherein the position measuring device can be realized with simple means, and thus economically, while reliably providing position measurement results with high precision and resolution.

This object is attained in accordance with the invention by the provision, in an industrial lift truck, of a position measuring device which includes at least one roller body that either a) is arranged on the element that is movable with the load lifting device such that it is capable of rotation and its circumference contacts a path running along the guide in such a way that it is forced to roll along the path by movement of the element that is movable with the load lifting device, or b) is arranged on an element that is stationary relative to the guide such that it is capable of rotation and its circumference contacts the element that is movable with the load lifting device in such a way that it is forced to rotate by movement of the element that is movable with the load lifting device, and wherein the roller body acts in combination with a sensor which transmits an electric signal as a function of the rotational movement of the roller body to an analysis circuit which evaluates the signal for determining the position of the element that is movable with the load lifting device or the position of the load carrier relative to the guide.

In an industrial lift truck in the form of a lift truck, the load lifting device is usually a load carrying fork that is arranged on a fork carrier and is vertically movable, together with the fork carrier, on a lifting frame or mast. For measuring the lift height of the load carrying fork, in accordance with alternative a) the roller body is arranged on the fork carrier or an element attached thereto for movement along the guide in such a manner that, for instance, it rolls along a path on the lifting frame that is parallel to the direction of lift. The rotational movement of the roller body is measured by the sensor so that the analysis circuit connected to the sensor can evaluate the electrical signal for determining the lift height supplied by the sensor.

On the other hand, the roller body can be arranged in accordance with alternative b), on an element that is stationary relative to the guide, where its circumference contacts the element that is movable with the load lifting device in such a way that it is forced to rotate by movement of the element that is movable with the load lifting device. Alternative b) has the advantage that the signal lines need not move, and can thus be laid in a fixed position.

The sensor is preferably a digital angular position sensor that is designed as an incremental sensor, and the analysis circuit contains a counter circuit that counts the pulses emitted by the angular position sensor as a function of the roller body's change in angle of rotation. Preferably, the incremental angular position sensor is designed to have at least two channels so that it emits two count pulse signals, preferably in quadrature, when the roller body revolves. The analysis circuit evaluates the count pulse signals in order to determine the roller body's direction of rotation and to count the count pulses from at least one of the count pulse signals, either up or down, depending on the direction of rotation. For example, when the load lifting device is raised, it can count up, and when the load lifting device is lowered, it can count down, so that the current count value at any given time can be used to determine lift height. To this end, the analysis circuit can be designed to redundantly evaluate both of the phase-shifted count pulse signals for safety reasons, in order to be able to detect any measurement errors.

In accordance with a preferred embodiment of the invention, the roller body is part of a roller bearing, for example, the outer ring of a roller bearing, or is arranged on the element that is movable with the load lifting device so as to rotate with the aid of a roller bearing. The use of a roller bearing with an integrated angular position sensor offers the advantage that only extremely small frictional torques need be overcome and the roller body can thus roll along its rolling path with no opposing torque to speak of. In test measurements, the roller body demonstrated no slip errors detectably impairing the reproducibility of the measurement results even after a number of translational movement cycles of the load lifting device. Even under conditions of a rolling path contaminated with a lubricant, measurement results were obtained that had a very high degree of reproducibility.

The invention also relates to industrial lift trucks in which the position of the load lifting device can be influenced by the superposition of motions of several elements that are movable relative to one another. For example, such a case is presented by a lift truck with a telescoping lifting frame having a lower lifting frame section and an upper lifting frame section that is telescopically extendable relative thereto, where the load lifting device is movable on the upper lifting frame section. For such a lift truck, it is proposed to measure the motion of the upper lifting frame section relative to the lower lifting frame section with a first roller body that is rotatably mounted on the upper lifting frame section and that can roll on the lower lifting frame section. To measure the movement of the load lifting device relative to the upper lifting frame section, it is proposed that a second roller body be rotatably mounted on an element that is connected to the load lifting device for common movement relative to the upper lifting frame section so as to be able to roll on the upper lifting frame section. The analysis circuit evaluates the rotational movement signals emitted by the roller body sensors in order to be able to monitor the positions of the load lifting device and the upper lifting frame section relative to the lower lifting frame section. This measuring principle can of course be extended to lifting frames with additional telescoping lifting frame sections.

Additional elements that are movable relative to one another can be provided between the load lifting device and a lifting frame of a lift truck, as is the case, for example, in what is known as a three-way, order-picking lift truck with adjustable-height operator's cab. In such a lift truck, an operator's cab is arranged on a main lifting frame so as to be adjustable in height, while a rotary/linear positioner, which has an auxiliary lifting frame that travels perpendicular to the direction of lift of the operator's cab, is arranged on the operator's cab. The load lifting device is arranged on the auxiliary lifting frame such that it can move parallel to the lift direction of the operator's cab and is adjustable in height relative to the operator's cab, while the load lifting device is additionally capable of pivoting relative to the operator's cab about an axis parallel to the lift direction of the operator's cab.

For measuring the translational movement, it is proposed that a roller body with appropriate sensor be arranged on the operator's cab such that it can rotate and roll along a path on the main lifting frame, and that an additional roller body be arranged on an element connected to the load lifting device for common movement relative to the auxiliary lifting frame such that it can rotate and roll along a path on the auxiliary lifting frame. The analysis unit can then determine, from the sensors' signals, the lift positions of the load lifting device and the operator's cab relative to the main lifting frame, and the lift position of the load lifting device relative to the auxiliary lifting frame. In addition, a roller body with sensor can be provided on the operator's cab in an appropriate manner for determining the lateral extension of the load lifting device. Naturally, in a lift truck with adjustable-height operator's cab and additionally movable load lifting device arranged thereupon, along the lines of the present invention, it is also possible that only the primary lift, namely that of the operator's cab lift position, is monitored by a roller body with appropriate sensor, and that some other measurement principle is used to measure the position of the load lifting device relative to the operator's cab.

THE DRAWINGS

An exemplary embodiment of the invention is described in greater detail below with reference to the drawings, in which.

DETAILED DESCRIPTION

Figure 1:
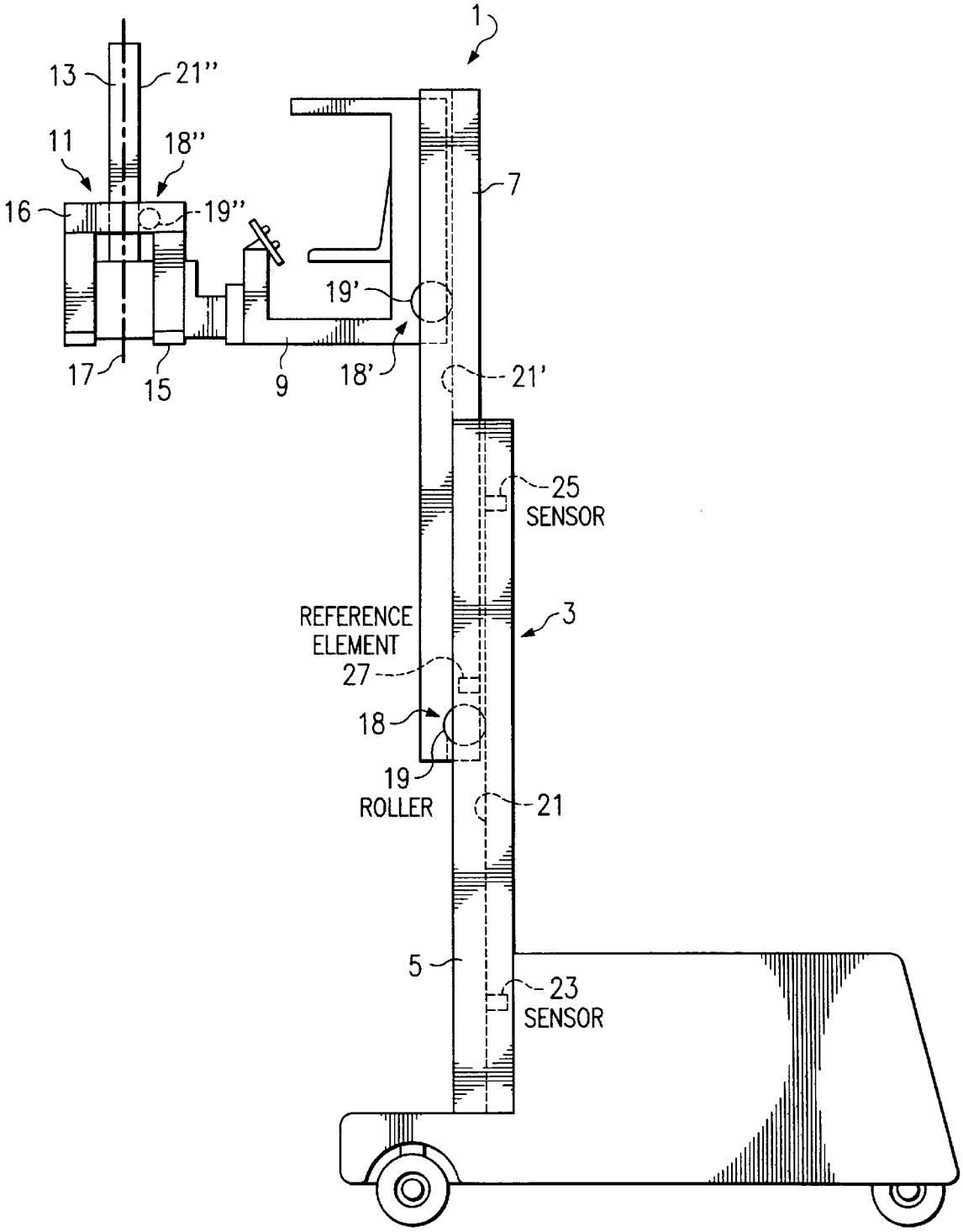
FIG. 1 shows a greatly simplified side view of an industrial lift truck according to the invention.

The lift truck 1 in FIG. 1 is a three-way, order-picking lift truck. The lift truck 1 has a telescoping lifting frame 3 with a lower lifting frame section 5, which is stationary relative to the chassis of the lift truck 1, and an upper lifting frame section 7, which can extend and retract in a vertical direction relative to the lower lifting frame section 5. An operator's cab 9 is supported on the upper lifting frame section 7 so as to be adjustable in height. Located on the front of the operator's cab 9 is a rotary/linear positioner 11 which is arranged so as to be laterally movable relative to the operator's cab 9, e.g. perpendicular to the plane of the drawing in FIG. 1, and which has an auxiliary lifting frame (auxiliary mast) 13, upon which a load lifting device (fork) 15 is attached by a mount 16 so as to be adjustable in height relative to the operator's cab 9. The auxiliary mast 13 can be pivoted together with the load lifting device 15 by approximately 180° about an axis 17.

Figure 4:
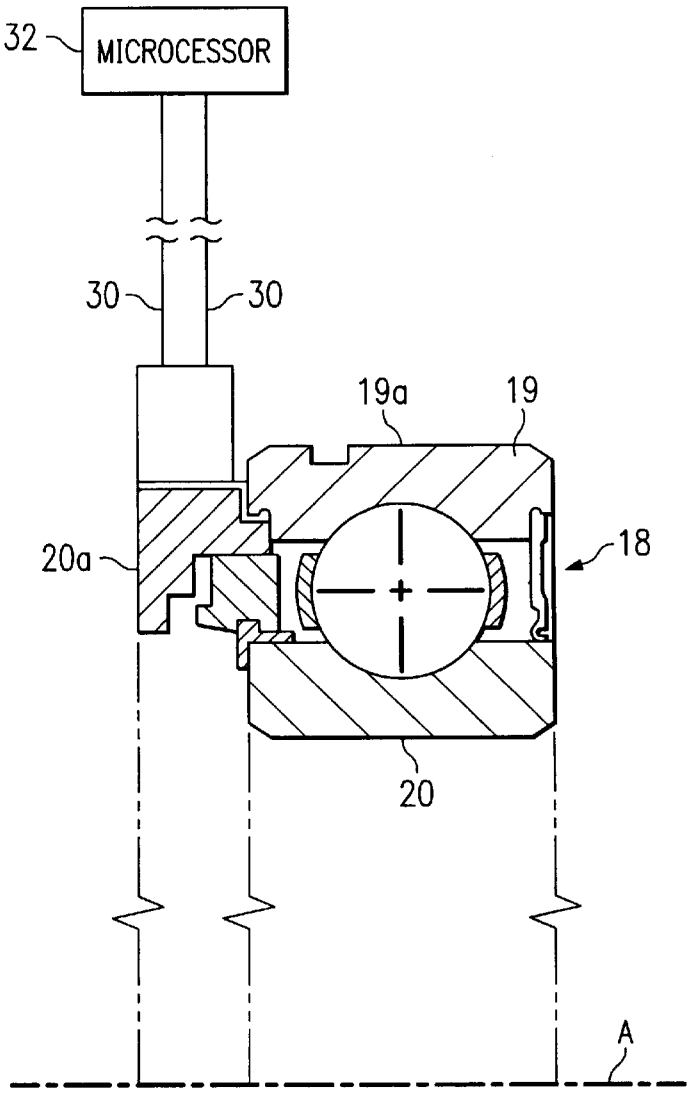
FIG. 4 shows a schematic view of an angular position sensor and an associated programmed microprocessor (analysis circuit).

As the sensor of a position measuring device, there is arranged on the upper lifting frame section 7 a roller bearing 18 in the form of an incremental angular position sensor whose rotatable outer ring 19 serves as a roller body with a roller axis A perpendicular to the direction of lift of the upper lifting frame 7. See FIG. 4. The position sensor may be a conventional unit of the type having two Hall effect sensors at different angular positions corresponding to the phase shift of their signals. The outer circumference 19*a* of the roller body 19 contacts a surface 21 of the lower lifting frame section 5 which forms a path running in the direction of lift of the upper lifting frame section 7, upon which the roller body 19 rolls when the upper lifting frame section 7 moves in telescoping fashion relative to the lower lifting frame section 5. The stationary inner ring 20 and mounting structure 20*a* of the roller bearing 18 are attached to the lifting frame section 7 in such a way that the roller body 19 is elastically preloaded toward its path 21, and thus is always in contact with the path.

In FIG. 1, the upper lifting frame section 7 is shown partially extended, while the cab 9 is shown in its uppermost position relative to the upper lifting frame section 7. The load lifting device 15 is in its lowest position relative to the auxiliary mast 13 and is pivoted to the side toward the viewer as shown in FIG. 1. The hydraulic drive devices for elements 7, 9, 11 and 15, which are conventional, are not shown.

Figure 2:
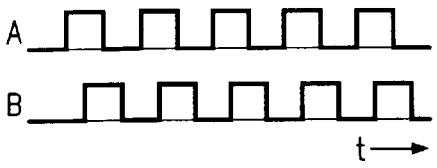
FIG. 2 shows phase-shifted pulse signals as are emitted by angular position sensors of the position measuring device.

When the roller body 19 rotates, the Hall effect sensors of the angular position sensor 18 generate two pulse trains in quadrature in the form of electric signals as indicated in FIG. 2. Each pulse interval corresponds to a specific change in the angular position of the roller body 19. The phase-shifted electrical signals are supplied over leads 30 to an analysis circuit 32 (FIG. 4) that has an up/down counter circuit to count the measurement signal pulses and determines the direction of rotation by comparing the two measurement signals. The analysis circuit may comprise a suitably programmed microprocessor, as is conventional. When the upper frame section 7 is raised, the counter circuit increments the pulse count of the appropriate measurement signal, whereas the counter circuit decrements the pulse count when the upper frame section 7 is lowered and the associated reversal takes place in the direction of rotation of the roller body 19. The analysis circuit determines the position of the upper lifting frame section 7 relative to the lower lifting frame section 5 from the pertinent count value. The analysis circuit can also determine the appropriate lift speed from the pulses counted per unit time, in which process the lift speed values can be used as actual values for lift speed regulation, for example as a function of the current position of the upper lifting frame section 7 relative to the lower lifting frame section 5, on the basic principle that the lift speed is reduced in a controlled fashion when the upper lifting frame 7 approaches its maximum permissible lift height position or another predefined position.

In the exemplary embodiment in FIG. 1, reference sensors are additionally provided for the position measuring device. In this example, these are proximity sensors 23 and 25, which are arranged on the lower lifting frame section 5 and transmit an appropriate reference signal to the analysis circuit when they are opposite a reference sensor element (marking) 27 attached to the upper lifting frame section 7 at a predetermined location. Using the reference signal, the analysis circuit can check the position value derived from the angular position sensor 18 and correct it if necessary. Moreover, the reference sensors can be used to calibrate the measurement range of the position measuring device, where the upper lifting frame section 7 is extended starting from its lowest base position so that the reference sensor element 27 is passed by the proximity sensors 23 and 25 in sequence. The analysis circuit determines the number of pulses per channel emitted by the angular position sensor 18 between the appearance of the first reference signal from proximity sensor 23 and the appearance of the second reference signal from proximity sensor 25, in order to normalize the predetermined distance between proximity sensors 23 and 25 so that a very exact relationship between position changes of the upper lifting frame section 7 and changes in angular position of the roller body 19 can be established. The sensors 23 and 25 can take the form of inductive proximity sensors, light beam switches or the like, and if necessary can take on additional functions, for instance as part of an endpoint detection circuit.

For referencing, one could also manage within the scope of the invention with just one reference sensor, for example reference sensor 23, which is arranged for instance at a predetermined distance above the lowest possible position that the reference element 27 assumes when the upper lifting frame section 7 is fully retracted in its lowest base position. Another possibility is to use just one reference sensor where the relevant reference sensor and the reference sensor element interact over a predetermined lift distance.

Figure 3:
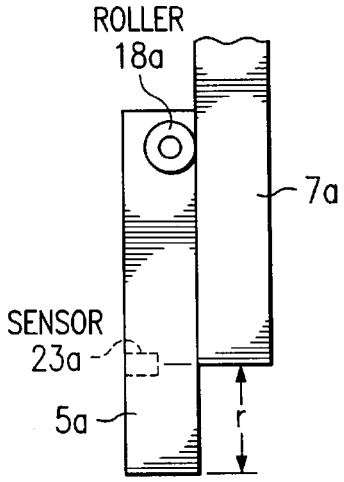
FIG. 3 shows a simplified partial representation of a telescoping lifting frame to explain a preferred referencing process.

For the purpose of explaining another referencing embodiment, FIG. 3 shows a lower lifting frame section 5*a,* and an upper lifting frame section 7*a* that can move in telescoping fashion relative thereto, of an adjustable-length lifting frame of an industrial lift truck in accordance with the invention.

In FIG. 3, the upper lifting frame section 7*a* is shown in a position in which it is raised a predetermined reference distance r as compared to its lowest possible rest position. The sensor 23*a* at the height of the reference distance r changes its output signal when the lifting frame section 7*a* extends upward past the reference distance r or reenters the reference distance region while moving down. FIG. 3 shows the upper lifting frame section 7*a* in a snapshot in which it is evoking a signal state change in the sensor 23*a*. From the signal state of sensor 23, an unambiguous determination can be made as to whether the lifting frame section 7*a* is outside the reference distance region r and must be lowered to bring its lower end into the reference distance region r for referencing.

For example, the following referencing process can take place:

1. Starting from the fully lowered base position of lifting frame section 7*a,* the lifting frame section 7*a* is raised until a signal state change is detected at sensor 23*a*. The signal state change indicates that sensor 23*a* is functioning.
2. Starting from the position shown in FIG. 3, the lifting frame section 7*a* is lowered the entire reference distance r until it has reached its lowest base position. During the process of lowering lifting frame section 7*a,* the analysis circuit checks the two phase-shifted electrical signals from angular position sensor 18*a* for the correct phase relationship for the case of lowering. In addition, the angular position sensor signal is evaluated in order to measure the reference distance r.
3. The lifting frame section 7*a* is again raised from the lowest base position until the reference sensor 23*a* changes its initial signal state.

The analysis circuit checks the phase-shifted electrical signals from the angular position sensor 18*a* for the correct phase sequence for the case of raising. In addition, the reference distance r is measured.

If the lifting frame section 7*a* is initially located outside the reference distance region r, the referencing can be performed in an appropriate fashion, omitting Step 1 above.

The following problems can be detected by the referencing process described above:

failure in the reference sensor 23*a* failure in or faulty signal of the angular position sensor 18*a,* any elongation or stretching of the lift chain customarily used to extend the lifting frame section 7*a,* faults in the analysis circuit or counter circuit.

FIG. 3 also shows the option that the angular position sensor 18*a* is arranged on the stationary lifting frame section in such a way that it can rotate and is set in rotation when the movable lifting frame section 7*a* is moved upward or downward.

In the exemplary embodiment shown in FIG. 1, an angular position sensor 18' corresponding to the angular position sensor 18 is arranged on the operator's cab 9; the associated roller body 19' rolls on a path 21' running in the lengthwise direction of the upper lifting frame section 7 when the operator's cab 9 is raised or lowered relative to the upper lifting frame section 7. For determining the position of the operator's cab 9 relative to the upper lifting frame section 7 or to the lower lifting frame section 5, the analysis circuit evaluates the appropriate pulse signals of the angular position sensor 18' arranged on the operator's cab 9. Reference sensors of the type described above can also be used for determining the position of the operator's cab 9.

An additional angular position sensor 18" corresponding to the angular position sensor 18 is arranged on an element 16 that is rigidly connected to the load lifting device 15; the associated roller body 19" rolls on a vertical path of the auxiliary mast 13 when the load lifting device 15 is raised or lowered relative to the auxiliary mast 13. The analysis circuit also evaluates the pulse signals of the latter angular position sensor 18" and can determine, from the relevant angular position sensor information, the lift height of the load lifting device 15 relative to the operator's cab 9 and relative to the lifting frame sections 7 and 5.

Of course, an angular position sensor corresponding to the angular position sensor 18 can also be provided on the operator's cab 9 for measuring the lateral extension of the load lifting device 15.

The invention makes possible precise position monitoring, which is accomplished with simple means, of the load lifting device and/or of the elements that can move with the load lifting device (elements 7, 9, 11 and 16 in the exemplary embodiment) relative to one another and relative to a fixed reference point on the industrial lift truck. The values for position and rate of change of position provided by the position measuring device can be used, for example, as instantaneous feedback comparison values for a drive control unit that controls the movement sequences of these elements.

Although the invention has been described herein by reference to exemplary embodiments thereof, it will be understood that such embodiments are susceptible of modification and variation without departing from the inventive concepts disclosed. All such modifications and variations, therefore, are intended to be included within the spirit and scope of the appended claims.

What is claimed is:

1. An industrial lift truck, comprising:

a load lifting device;

a device for moving the load lifting device on the lift truck and having at least one element that can move, together with the load lifting device, along a substantially straight guide;

a position measuring device for monitoring the relative position to the guide of the element movable with the load lifting device or of the load lifting device;

said position measuring device including at least one roller body which, when the element that is movable with the load lifting device moves, executes a rotary motion and acts in combination with a sensor which transmits an electric signal as a function of the rotational movement of the roller body to an analysis circuit which evaluates the signal to determine the position of the element that is movable with the load lifting device, or the position of the load carrier, relative to the guide; and said roller body being part of a roller bearing or mounted by means of a roller bearing so as to be rotatable and being arranged on the element that is movable with the load lifting device such that it is capable of rotation and its circumference contacts a path running along the guide in such a way that it is forced to roll along the path by movement of the element that is movable with the load lifting device along the guide.

2. An industrial lift truck, comprising:

a load lifting device;

a device for moving the load lifting device on the lift truck and having at least one element that can move, together with the load lifting device, along a substantially straight guide;

a position measuring device for monitoring the position relative to the guide of the element that is movable with the load lifting device or of the load lifting device;

said position measuring device including at least one roller body which is arranged on an element that is stationary relative to the guide such that it is capable of rotation and its circumference contacts the element that is movable with the load lifting device in such a way that it is forced to rotate by movement of the element that is movable with the load lifting device, said roller body being part of a roller bearing or is mounted by means of a roller bearing so as to be rotatable; and said roller body acts in combination with a sensor which transmits an electric signal as a function of the rotational movement of the roller body to an analysis circuit which evaluates the signal to determine the position of the element that is movable with the load lifting device, or the position of the load carrier, relative to the guide.

3. An industrial lift truck according to claim 1, wherein the roller bearing includes an integrated angular position sensor.

4. An industrial lift truck according to claim 1, 2 or 3, wherein the sensor is a digital angular position sensor.

5. An industrial lift truck according to claim 4, wherein:

the digital angular position sensor comprises an incremental angular sensor; and the analysis circuit contains a counter circuit for counting the pulses emitted by the angular position sensor as a function of the rotation of the roller body.

6. An industrial lift truck according to claim 5, wherein:

the incremental angular position sensor emits two phase-shifted pulse signals upon rotation of the roller body; and the analysis circuit is operative to process the pulse signals to determine the direction of rotation of the roller body and to perform up or down counting of the pulses from at least one of the pulse signals as a function of the direction of rotation.

7. An industrial lift truck according to claim 1 or 2, wherein:

the element that is movable with the load lifting device is mounted on a lifting frame so as to be adjustable in height; and the position measuring device is arranged to determine the lift height of the load lifting device.

8. An industrial lift truck according to claim 1 or 2, further comprising:

a lifting frame with an operator's cab mounted thereupon so as to be adjustable in height and carrying a load lifting device; and the roller body is rotatably arranged on the operator's cab and can roll along the lifting frame.

9. An industrial lift truck according to claim 1 or 2, further comprising:

a lifting frame for the load lifting device, said lifting frame being adjustable in length and having a lower lifting frame section and an upper lifting frame section that is telescopically extendable relative thereto;

the roller body is rotatably mounted on the upper lifting frame section and can roll on the lower lifting frame section.

10. An industrial lift truck according to claim 1 or 2, further comprising:

a lifting frame for the load lifting device, said lifting frame being adjustable in length and having a lower lifting frame section and an upper lifting frame section that is telescopically extendable relative thereto; and the roller body is rotatably mounted on the lower lifting frame section and can roll on the upper lifting frame section.

11. An industrial lift truck according to claim 1 or 2, further comprising:

at least one reference sensor which emits a reference signal to the analysis circuit when the element that is movable with the load lifting device is in a predetermined position; and the analysis circuit compares the measured position value present at the position measuring device when the reference signal is received with a desired position value, and as a function of this comparison, calibrates the position measuring device if necessary.

* * * * *